US008212728B2

(12) United States Patent
Ide

(10) Patent No.: US 8,212,728 B2
(45) Date of Patent: Jul. 3, 2012

(54) FOLDABLE PORTABLE RADIO DEVICE

(75) Inventor: Yoshiyuki Ide, Tokyo (JP)

(73) Assignee: NEC Corporation, Tokyo (JP)

( * ) Notice: Subject to any disclaimer, the term of this patent is extended or adjusted under 35 U.S.C. 154(b) by 334 days.

(21) Appl. No.: 12/670,463

(22) PCT Filed: Jul. 22, 2008

(86) PCT No.: PCT/JP2008/063103

§ 371 (c)(1),
(2), (4) Date: Jan. 25, 2010

(87) PCT Pub. No.: WO2009/019972

PCT Pub. Date: Feb. 12, 2009

(65) Prior Publication Data

US 2010/0207824 A1 Aug. 19, 2010

(30) Foreign Application Priority Data

Aug. 9, 2007 (JP) ..... 2007-208270

(51) Int. Cl.
*H01Q 1/24* (2006.01)

(52) U.S. Cl. ..... 343/702; 455/575.3; 455/575.7

(58) Field of Classification Search ..... 343/702, 343/725; 455/575.1, 575.3, 575.7
See application file for complete search history.

(56) References Cited

U.S. PATENT DOCUMENTS

| | | | | |
|---|---|---|---|---|
| 7,502,638 | B2 * | 3/2009 | Shimizu et al. | 455/575.7 |
| 7,787,922 | B2 * | 8/2010 | Yamazaki et al. | 455/575.7 |
| 7,821,463 | B2 * | 10/2010 | Nishikido et al. | 343/702 |
| 2006/0183512 | A1 * | 8/2006 | Segawa et al. | 455/575.1 |
| 2007/0037617 | A1 * | 2/2007 | Hamamura et al. | 455/575.3 |
| 2007/0161419 | A1 * | 7/2007 | Dakeya | 455/575.7 |

FOREIGN PATENT DOCUMENTS

| | | | |
|---|---|---|---|
| JP | 10-303622 | A | 11/1998 |
| JP | 2003243917 | A | 8/2003 |
| JP | 2007074491 | A | 3/2007 |
| JP | 2007158718 | A | 6/2007 |

OTHER PUBLICATIONS

International Search Report for PCT/JP2008/063103 mailed Sep. 30, 2008.

* cited by examiner

*Primary Examiner* — Hoang V Nguyen

(57) ABSTRACT

A foldable portable radio device comprises a first housing, a second housing, a hinge section for coupling the first and second housings such that the radio device is foldable, a radio communication antenna built in a region of the first or second housing near the hinge section, and a digital television reception whip antenna which can be retracted into and drawn out from the region near the hinge section where the radio communication antenna is built in. The foldable portable radio device also comprises a function for powering the digital television reception whip antenna through an electric connection pattern, wherein the electric connection pattern is formed in a direction away from the region near the hinge section where the radio communication antenna is built in.

5 Claims, 2 Drawing Sheets

FOLDABLE PORTABLE RADIO DEVICE

This application is the National Phase of PCT/JP2008/063103, filed Jul. 22, 2008, which claims the priority based on Japanese Patent Application 2007-208270 filed Aug. 9, 2007, the disclosure of which is incorporated herein by reference in its entirety.

TECHNICAL FIELD

The present invention relates to a foldable portable radio device which comprises a radio communication antenna and a digital television reception antenna.

BACKGROUND ART

In conventional foldable portable radio devices, a multi-band supporting built-in antenna is often arranged near a hinge section of a foldable housing. Further, when a digital television reception antenna is added to this type of radio device, a telescopic whip antenna is often mounted near the hinge section, with the result that the antennas are in close proximity to each other.

A loss due to mutual coupling, and the like are envisaged in recent portable radio devices which are desired to be increasingly reduced in size, whereas in portable radio devices capable of receiving digital television, a radio wave emitted from a radio communication antenna can be absorbed by a digital television reception antenna, arranged in close proximity thereto, to cause a loss. As a solution for avoiding the loss, a method is contemplated to mount one antenna in a lower end region of a housing spaced apart from a hinge section (see JP2007-74491A). However, considering a scenario where a small portable radio device is used near a human body, particularly when held by a hand, this solution is not advisable because a loss due to a human body is a concern for either of the antennas if the antenna is mounted in a lower end region of a housing, where the antenna is more likely to be grasped.

DISCLOSURE OF THE INVENTION

It is an object of the present invention to provide a foldable portable radio device which is capable of solving the problem inherent to the background art. An example of the object is to provide a portable radio device which is capable of alleviating a loss due to mutual coupling between antennas and exhibiting satisfactory antenna characteristics in a foldable portable radio device which comprises a radio communication antenna and a digital television reception antenna, which are mounted in close proximity to each other near a hinge section.

One aspect of the present invention is a foldable portable radio device comprising a first housing, a second housing, and a hinge section for coupling the first and second housings such that the radio device is foldable. Also, a radio communication antenna is built in a region of the first or second housing near the hinge section, and a digital television reception whip antenna can be retracted into and drawn out from the region near the hinge section where the radio communication antenna is built in.

In regard to such a portable radio device, the present invention is characterized by comprising a function for powering the digital television reception whip antenna through an electric connection pattern, wherein the electric connection pattern is formed in a direction away from the region near the hinge section where the radio communication antenna is built in.

The present invention is further characterized in that a power supply section for the electric connection pattern is disposed at a position further apart from the region near the hinge section where the radio communication antenna is built in than a power supply of the radio communication antenna.

A diagram schematically showing the configuration of a portable radio device according to Embodiment 1 of the present invention, depicting a manner in which a digital television reception antenna is drawn out from a lower housing while an upper housing is opened with respect to the lower housing.

FIG. 2

A diagram schematically showing the configuration of the portable radio device according to Embodiment 1 of the present invention, depicting a manner in which the digital television reception antenna is retracted in the lower housing while the upper housing is opened with respect to the lower housing.

FIG. 3

A diagram schematically showing the configuration of a portable radio device according to Embodiment 2 of the present invention, depicting a manner in which a digital television reception antenna is drawn out from a lower housing while an upper housing is opened with respect to the lower housing.

FIG. 4

A diagram schematically showing the configuration of the portable radio device according to Embodiment 2 of the present invention, depicting a manner in which the digital television reception antenna is retracted in the lower housing while the upper housing is opened with respect to the lower housing.

BEST MODE FOR CARRYING OUT THE INVENTION

In the following, embodiments of the present invention will be described with reference to the accompanying drawings.

Embodiment 1

Figure 1:
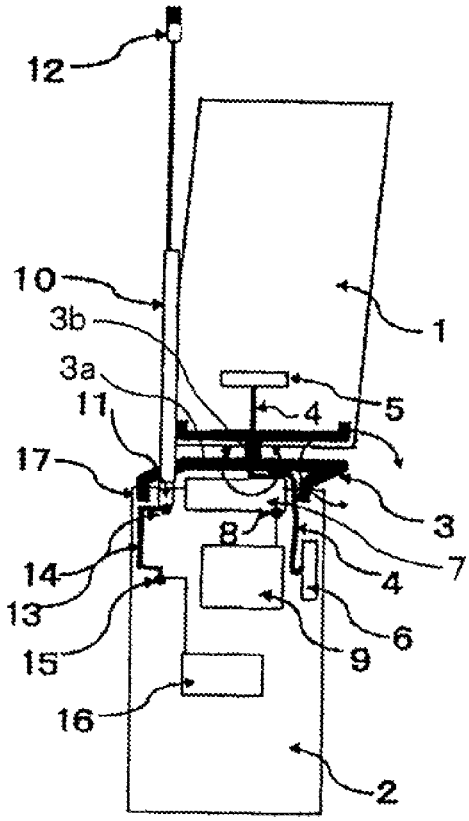
FIG. 1
Figure 2:
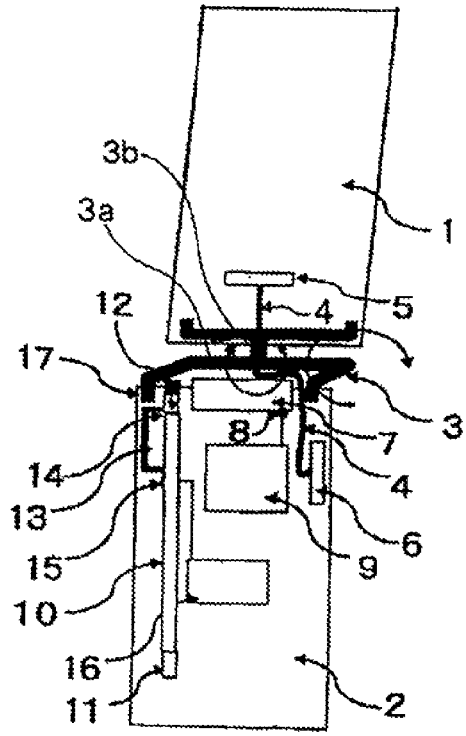

FIGS. 1 and 2 are schematic diagrams of a portable radio device according to Embodiment 1 of the present invention, showing a state where an upper housing is opened with respect to a lower housing by a hinge section of the portable radio device.

In these figures, the portable radio device comprises an upper housing (not shown) which contains upper board 1, and a lower housing which contains lower board 2, and ends of upper board 1 and lower board 2 are coupled to each other by biaxial hinge fitting 3.

Specifically, first shaft 3*a* of biaxial hinge fitting 3 is arranged in a coupling end with the lower board 2 on upper board 1, second shaft 3*b* is arranged perpendicularly to and for rotation relative to this first shaft 3*a*, and a coupling end with upper board 1 on lower board 2 is rotatably attached to this second shaft 3*b*. In this way, the upper housing and lower housing can be opened/closed about first shaft 3*a* of biaxial hinge fitting 3 from a state in which they lie one upon the other, and the upper housing can be rotated about second shaft 3*b* of biaxial hinge fitting 3 to turn inside out.

Thin coaxial cables 4 are routed between upper board 1 and lower board 2 for connecting biaxial hinge fitting 3 to both boards 1, 2. Thin coaxial cable 4 connected to biaxial hinge fitting 3 is connected to upper board 1 through connection 5 on upper board 1, and connected to lower board 2 through connection 6 on lower board 2. Biaxial hinge fitting 3 is electrically connected to upper board 1 and lower board 2 at three points outside of fitting non-connected region 17.

Lower board 2 is provided with radio communication antenna 7 which supports a plurality of bands, and digital television reception antenna 10 near biaxial hinge fitting 3.

Radio communication antenna 7 is disposed near biaxial hinge fitting 3 of lower board 2 as a built-in antenna, and is electrically connected to radio circuit 9 on lower board 2 through power supply 8. In this way, transmission/reception can be made through radio communication antenna 7.

Digital television reception antenna 10 is a communication whip antenna which can be retracted into and drawn out from the lower housing, and comprises a contact terminal 11 at its lower end and contact terminal 12 at its upper end.

Auxiliary pattern 13 (electric connection pattern) is further disposed on lower board 2 such that contact terminals 11, 12 can be electrically connected to upper end 14 of auxiliary pattern 13 when antenna 10 is retracted or drawn out. Auxiliary pattern 13 can be comprised of a conductor pattern on a fitting or a printed wiring board.

Upper end 14, which is one end of auxiliary pattern 13, is arranged near biaxial hinge fitting 3 of lower board 2, and auxiliary pattern 13 is deployed over a predetermined range in a direction away from the vicinity of biaxial hinge fitting 3.

A lower end, which is the other end of auxiliary pattern 13, is provided with power supply 15 which is electrically connected to digital television reception circuit 16.

As a solution for alleviating a loss due to mutual coupling of radio communication antenna 7 with digital television reception antenna 10, power supply 15 for digital television reception antenna 10 is disposed at a position spaced apart from power supply 8 for radio communication antenna 7.

FIG. 1 shows a state where digital television reception antenna 10 is drawn out from the lower housing. In this extended state, contact terminal 11 at the lower end of digital television reception antenna 10 is connected to upper end 14 of auxiliary pattern 13. In this way, digital television reception antenna 10 is connected to digital television reception circuit 16, and enables reception.

FIG. 2 shows a state where digital television reception antenna 10 is retracted in the lower housing. In this retracted state, contact terminal 12 at the upper end of digital television reception antenna 10 is connected to upper end 14 of auxiliary pattern 13. In this way, digital television reception antenna 10 is connected to digital television reception circuit 16, and enables reception.

Next, the operation of this embodiment will be described with reference to FIGS. 1 and 2.

In the extended state, shown in FIG. 1, of digital television reception antenna 10, which can be drawn out from and retracted into the lower housing (not shown) which contains lower board 2 of the portable radio device, contact terminal 11 disposed at the lower end of digital television reception antenna 10 is connected to upper end 14 of auxiliary pattern 13.

In the state of FIG. 2, where digital television reception antenna 10 is retracted in the housing, contact terminal 12 disposed at the upper end thereof is connected to upper end 14 of auxiliary pattern 13.

Digital television reception antenna 10 is connected to digital television reception circuit 16 through power supply 15 disposed on lower board 2, and therefore enables reception, in either of the extended and retracted states.

Radio communication antenna 7 and digital television reception antenna 10 are mounted side by side near biaxial hinge fitting 3. However, since digital television antenna 10 is connected to power supply 15 through auxiliary pattern 13, this power supply 15 is positioned away from the hinge section by a distance equivalent to the area of auxiliary pattern 13. In this way, digital television antenna 10 on one hand can be powered at a position further away from the actual position of the antenna, thus making it possible to alleviate a loss due to the mutual coupling of both antennas 7, 10.

More specifically, for avoiding a loss due to mutual coupling with radio communication antenna 7 which supports multiple bands, digital television antenna 10 is powered through auxiliary pattern 13. In this way, power supply 15 of the digital television antenna can be disposed away from power supply 8 of the radio communication antenna, so that power supplies 8, 15 can be spaced apart from each other.

Further, even when the digital television reception whip antenna is short, the electric length can be extended by auxiliary pattern 13 to ensure reception characteristics. Further, if auxiliary pattern 13 comprised of a conductor pattern on a fitting or a printed circuit board is made in the shape of meander, the electric length can be more extended for ensuring the reception characteristics.

According to this embodiment as described above, in a foldable portable radio device which has upper board 1 and lower board 2 coupled through biaxial hinge fitting 3, even if radio communication antenna 7 and digital television reception antenna 10 are disposed in the hinge section, their respective characteristics can be ensured.

Embodiment 2

Figure 3:
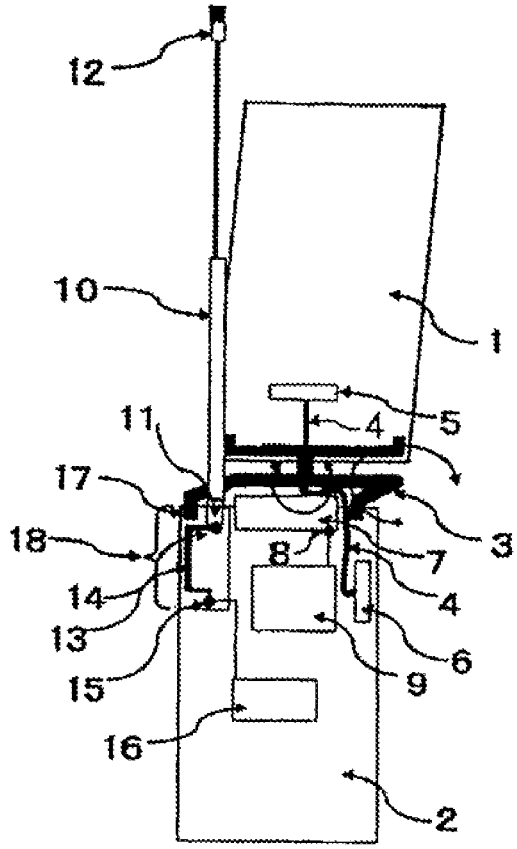
Figure 4:
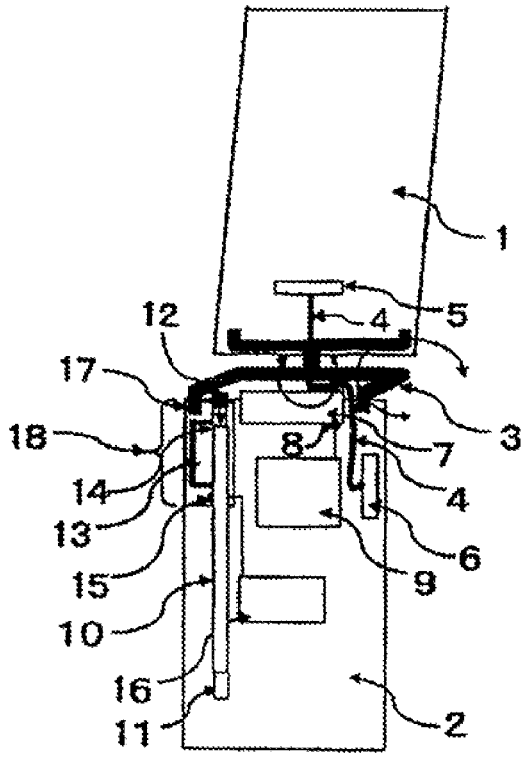

FIGS. 3 and 4 are schematic diagrams of a portable radio device according to Embodiment 2 of the present invention, showing a state where an upper housing is opened with respect to a lower housing by a hinge section of the portable radio device. Specifically, FIG. 3 shows a state where digital television reception antenna 10 is drawn out from a lower housing. FIG. 4 shows a state where digital television reception antenna 10 is retracted in the lower housing.

The following description will be given of parts different from the configuration of Embodiment 1. In this regard, the same reference numerals are used for the same components as those in Embodiment 1 in FIGS. 3 and 4, and descriptions thereon are omitted.

In this embodiment, in addition to the configuration described in Embodiment 1, a peripheral portion close to auxiliary pattern 13 is removed from a ground section of lower board 2. Stated another way, auxiliary pattern 13 is arranged in ground free section 18 on lower board 2. With this configuration, a radio wave loss can be alleviated by avoiding electromagnetic coupling of the ground section disposed on lower board 2 with auxiliary pattern 13.

Of course, similar actions and advantages can be produced in this Embodiment 2 as well.

Notably, in each embodiment described above, the lower housing and upper housing are coupled by the biaxial hinge, but the hinge section in the foldable portable radio device of the present invention is not limited to the biaxial hinge. Also, it should be understood that the antenna powering structure according to the present invention can also be applied to a foldable portable radio device which can horizontally throw an upper housing, including a display, down sideways.

While the present invention has been described above with reference to embodiments, the present invention is not limited to the foregoing embodiments. The present invention can be modified in shape and details in various manners which can be understood by those skilled in the art within the scope of the technical idea of the present invention.

The invention claimed is:

1. A foldable portable radio device comprising a first housing, a second housing, a hinge section for coupling said first and second housings such that said radio device is foldable, a radio communication antenna built in a region of said first or second housing near said hinge section, and a digital television reception whip antenna which can be retracted into and drawn out from the region near said hinge section where said radio communication antenna is built in, said foldable portable radio device characterized by comprising:

a function for powering said digital television reception whip antenna through an electric connection pattern, wherein said electric connection pattern is formed in a direction away from the region near said hinge section where said radio communication antenna is built in.

2. The foldable portable radio device according to claim 1, wherein a section for supplying power to said electric connection pattern is disposed at a position that is further apart, than a section for supplying power to said radio communication antenna, from the region near said hinge section where said radio communication antenna is built-in.

3. The foldable portable radio device according to claim 1, wherein said electric connection pattern is in the shape of meander.

4. The foldable portable radio device according to claim 1, wherein said electric connection pattern is formed of a conductor pattern on a printed board.

5. The foldable portable radio device according to claim 4, wherein a portion adjacent to said electric connection pattern is removed from a ground section disposed on said printed board.

* * * * *